US007106147B1

(12) United States Patent
Zadehgol et al.

(10) Patent No.: US 7,106,147 B1
(45) Date of Patent: Sep. 12, 2006

(54) APPARATUS, SYSTEM, AND METHOD FOR HIGH FREQUENCY SIGNAL DISTRIBUTION

(75) Inventors: Ata Zadehgol, Folsom, CA (US); Henri J. Maramis, Folsom, CA (US)

(73) Assignee: Intel Corporation, Santa Clara, CA (US)

( * ) Notice: Subject to any disclaimer, the term of this patent is extended or adjusted under 35 U.S.C. 154(b) by 44 days.

(21) Appl. No.: 10/820,648

(22) Filed: Apr. 8, 2004

(51) Int. Cl.
*H01P 5/12* (2006.01)

(52) U.S. Cl. ..... 333/125

(58) Field of Classification Search ..... 333/125, 333/124
See application file for complete search history.

(56) References Cited

U.S. PATENT DOCUMENTS 4,291,278 A * 9/1981 Quine ..... 330/286
4,583,061 A * 4/1986 O'Shea ..... 333/116
4,599,584 A * 7/1986 Sasser et al. ..... 333/125
4,835,496 A * 5/1989 Schellenberg et al. ..... 333/128
4,885,557 A * 12/1989 Barczys ..... 333/124
4,947,143 A * 8/1990 Abouzahra et al. ..... 333/125
5,025,233 A * 6/1991 Leonakis ..... 333/128
6,333,682 B1 * 12/2001 Seely et al. ..... 333/128

* cited by examiner

*Primary Examiner*—Robert Pascal
*Assistant Examiner*—Kimberly E. Glenn
(74) *Attorney, Agent, or Firm*—Troutman Sanders LLP; James E. Schutz; James H. Yancey, Jr.

(57) ABSTRACT

In some embodiments, an apparatus, system, and method for high frequency signal distribution may input a source signal and provide a plurality of outputs having equal phase and magnitude using a pie-divider 205. The pie-divider 205 may include an input section 305, 315, a body section 320, and a plurality of outputs 310. The body section 320 of the pie-divider 205 may have a generally pie-shaped geometry and distribute an input signal to each of the outputs 310 equally. The pie-divider 205 may comprise a conductive material. Additionally, other embodiments are described and claimed.

26 Claims, 4 Drawing Sheets

APPARATUS, SYSTEM, AND METHOD FOR HIGH FREQUENCY SIGNAL DISTRIBUTION

BACKGROUND

In computer systems and communications systems it is often desirable to replicate or divide signals to provide a signal to more than one input. This may be desirable in a variety of systems in which it would be beneficial to replicate a signal for provision to a plurality of devices or a plurality of inputs. One such system may be a testing system in which it would be desirable to test multiple devices simultaneously using substantially identical inputs. In such a system, the input signals may be generated individually, or individual input signals may be divided and provided to a plurality of devices.

In order for accurate testing results to be attained, the inputs may need to be substantially identical. Standard techniques for dividing signals often fail to maintain accurate signal levels or signal phases when dividing the signals. In many systems, this inaccuracy may compromise accurate testing. For example, and not limitation, certain systems may require the testing of the tolerance of input and output levels. If the inputs are not exactly as desired, a device may pass or fail various tests based on faulty inputs and thus produce inaccurate test results.

Additionally, inaccurate testing may increase production costs as accurate devices may fail a test and be rejected due to a faulty input signal. Also, the reverse situation may prove to be even more costly as faulty devices may appear to pass a test due to a faulty input signal. Those skilled in the art of system design and testing will recognize the importance of accurate input data when testing components.

Furthermore, those skilled in the art will recognize the benefit of testing many devices in parallel without the need for a separate signal generator to generate an input signal for each device to be tested. A low cost signal divider that produces accurate results may eliminate the need for numerous expensive signal generators by allowing a single signal to be divided and provided to a plurality of devices.

In addition to testing systems, the need for accurately dividing a signal into a plurality of substantially identical signals may exist in a variety of contexts. Any system in which a signal is provided to a plurality of devices may benefit from a device capable of accurately dividing the signal while maintaining accurate magnitude and phase.

DETAILED DESCRIPTION OF THE EMBODIMENTS

Figure 1:
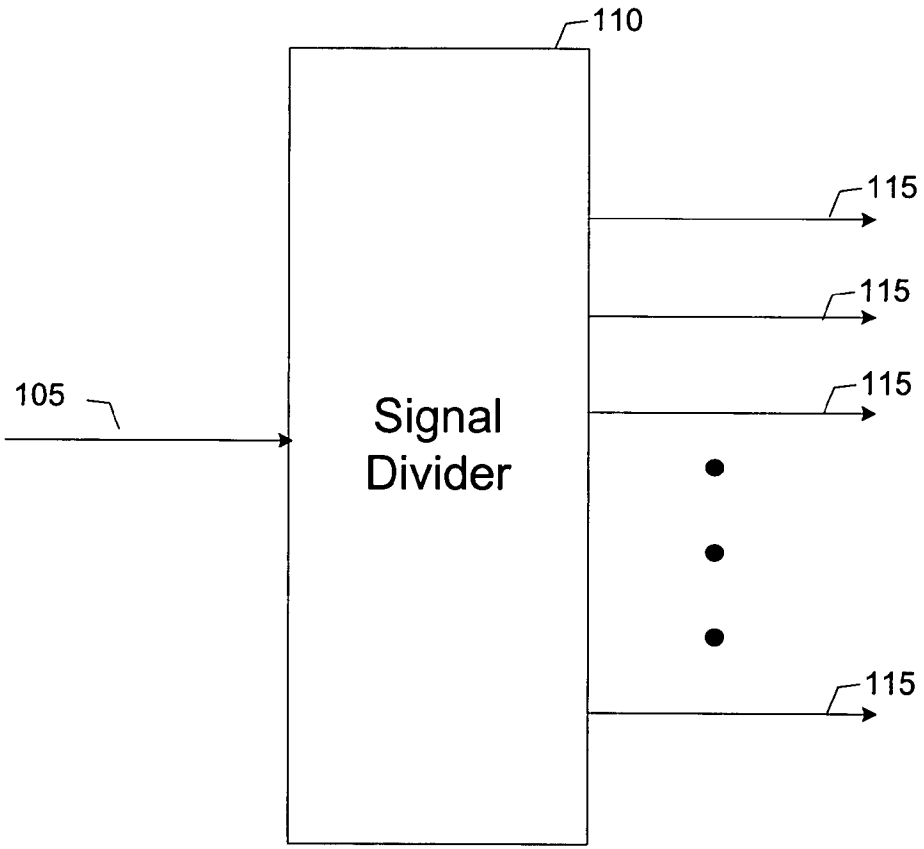
FIG. 1 is a block diagram illustrating a conceptual representation of an exemplary embodiment of the present invention.

Referring now to the drawings, in which like numerals refer to like parts throughout the several views, FIG. 1 displays a block diagram representation of an exemplary embodiment of the present invention. As shown in FIG. 1, a system in accordance with an embodiment of the present invention may include a signal divider 110 adapted to receive an input signal 105 and output a plurality of output signals 115. The input signal 105 may be provided by a signal generator. Alternatively, the input signal 105 may be provided by any electronic device capable of providing an analog or digital signal. Throughout the present description, while exemplary embodiments of the invention may be described in conjunction with signal testing systems and devices, the present invention is not intended to be limited to such systems and devices. Rather, the present invention may be embodied in any system or device in which signal division or duplication is desired.

Figure 2:
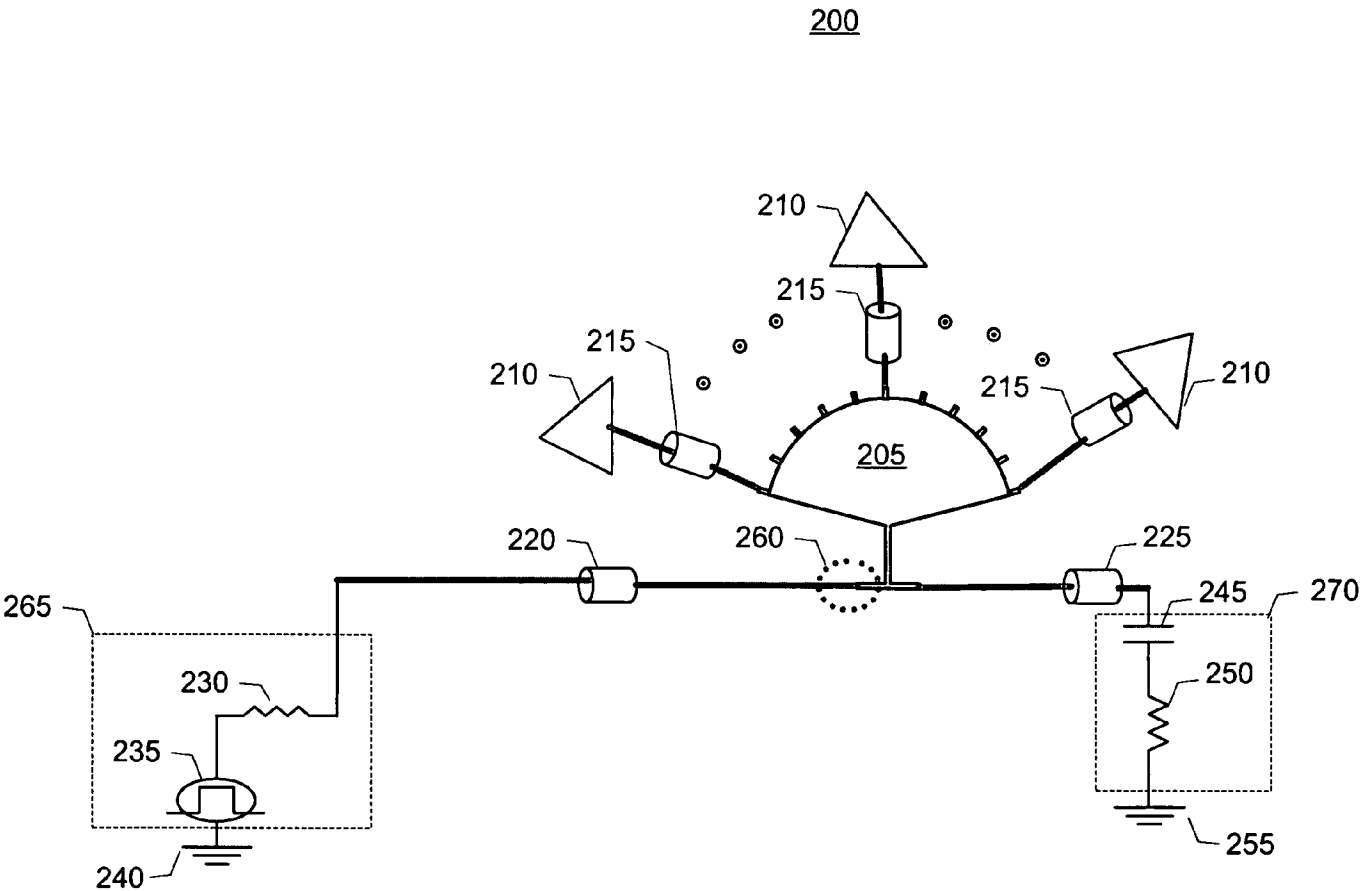
FIG. 2 is a block diagram illustrating an exemplary embodiment of the present invention.

FIG. 2 is a block diagram illustrating an exemplary embodiment of the present invention. As shown in FIG. 2, a system 200 may include, but is not limited to, a source transmission line 220, a pie-divider 205, a plurality of output transmission lines 215, a plurality of output loads 210, a termination transmission line 225, and a termination device 270. The termination device 270 may include a termination capacitor 245, and a termination resistor 250. Additionally, the system 200 may also include an input signal generator 265. As illustrated in FIG. 2 the input signal generator 265 may include a voltage source 235 having an impedance (Zsource) 230. As shown in FIG. 2, the output loads 210 may be op-amps 210.

The source transmission line 220 transmits a source signal from a signal source 265 to the pie-divider. The source transmission line 220 may also provide impedance matching between the signal source 265 and the remainder of the circuit. This matching section 220 may be optimized based on the characteristics of the signal source 265, the pie-divider 205, the transmission lines 215, the outputs 210, the termination transmission line 225, and the termination device 270.

Figure 3:
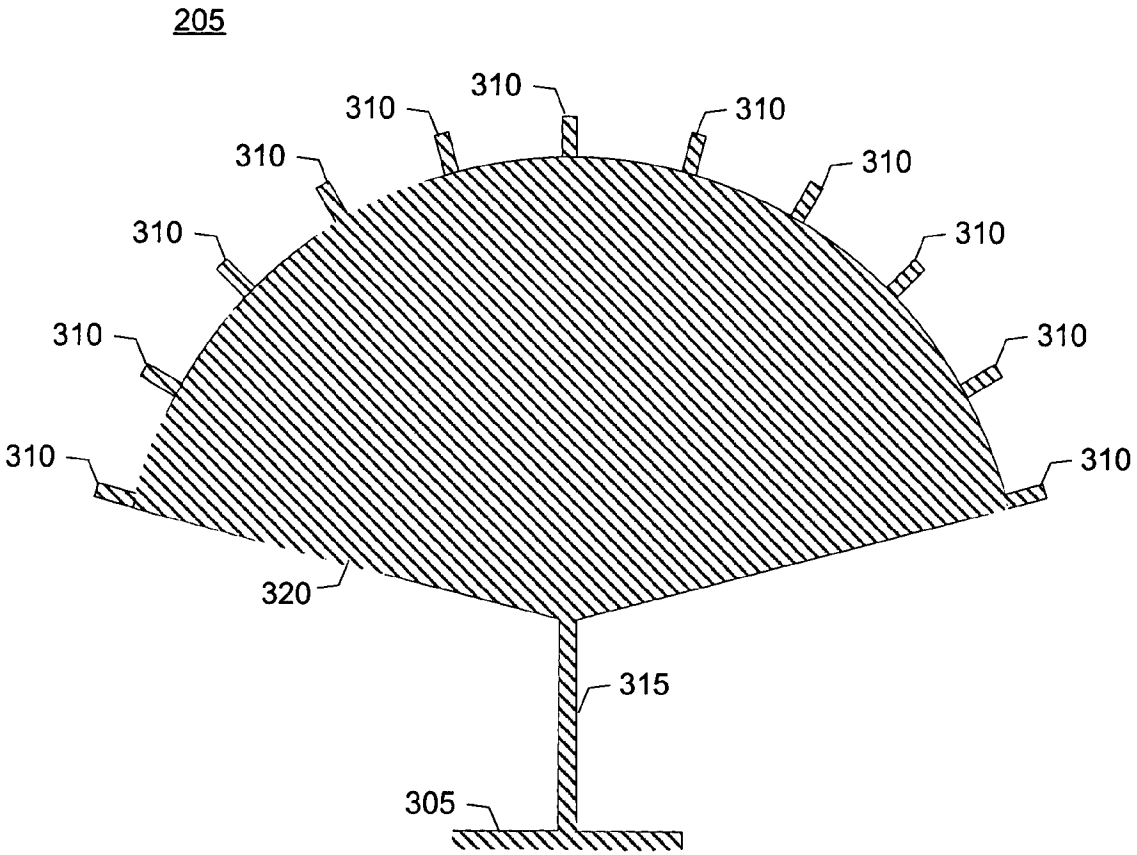
FIG. 3 is a schematic drawing showing the topography of a pie-divider in accordance with an exemplary embodiment of the present invention.

FIG. 3 is a schematic drawing of the topography of a pie-divider 205 in accordance with an exemplary embodiment of the present invention. As shown in FIG. 3, the pie-divider 205 may be implemented using a conductive fill zone having predetermined dimensions. For example, and not limitation, the pie-divider 205 may be constructed from copper fill. Alternatively, any other suitable conductive material may be used such as, but not limited to, tin, gold, silver, brass, or the like. Throughout the present description, the conductive material may be referred to as copper, however this is not intended to limit the composition of the conductive material in any way. Further, the pie-divider 205 may be constructed using a variety of techniques including, but not limited to: etching a cavity into a substrate and then filling it with conductive material, etching away unneeded copper from a copper-clad substrate leaving the desired pie-divider 205 dimensions in copper, or any other method of producing a predetermined geometric region of conductive material on a substrate. Additionally, the pie-divider and any associated circuitry may be fabricated using lamination methods, buildup methods, or any other fabrication method know to those of skill in the art.

As shown in FIG. 3, the input regions 305, 315, the body region 320, and the outputs 310 of the pie-divider 205 are typically constructed of the same conductive material. Alternatively, these regions may utilize different conductive materials in order to modify the size, shape, or electrical characteristics of the structure.

In an exemplary embodiment of the present invention, the pie-divider 205 may be optimized to efficiently and accurately divide the input signal 105 into a plurality of output signals 115 having equal phase and magnitude. The pie-divider 205 may be optimized by adjusting its size based on the characteristics of input and output loads. For example, and not limitation, the length and width of the outputs 310 may be adjusted to impedance match the pie-divider 205 to the output loads 210, such as the input impedance of the op-amps 210. Additionally, such optimization or impedance matching may be performed on any of the dimensions of the pie-divider including, but not limited to, the length and width of the input regions 305, 315 and the outputs 310, and the volume of the body region 320. Various methods of optimizing a circuit for specific input and output loads are well know to those of skill in the art of microwave circuit design. Such methods may include, but are not limited to, optimization performed by empirically or experimentally optimizing the circuit. For example, and not limitation, multivariate optimization techniques may be utilized to parametrically optimize system performance to achieve predetermined goals.

Referring back to FIG. 2, the system 200 may be configured using a variety of source and load components. Often, it may be desirable to optimize the pie-divider 205 in accordance with the source and load components to achieve desired results. For example, in an exemplary embodiment of the present invention, the loading elements may be op-amps 210. In an embodiment, the op-amps 210 may have an input resistance of 400 K Ohms (Rin=400 K Ohms) and an input capacitance of 1.3 pico farads (Cin=1.3 pF). Alternatively, the op-amps 210, or other load device, may have different load characteristics. The pie-divider 205 may be customized in accordance with these load characteristics to achieve desired results and to impedance match the circuit.

Figure 4:
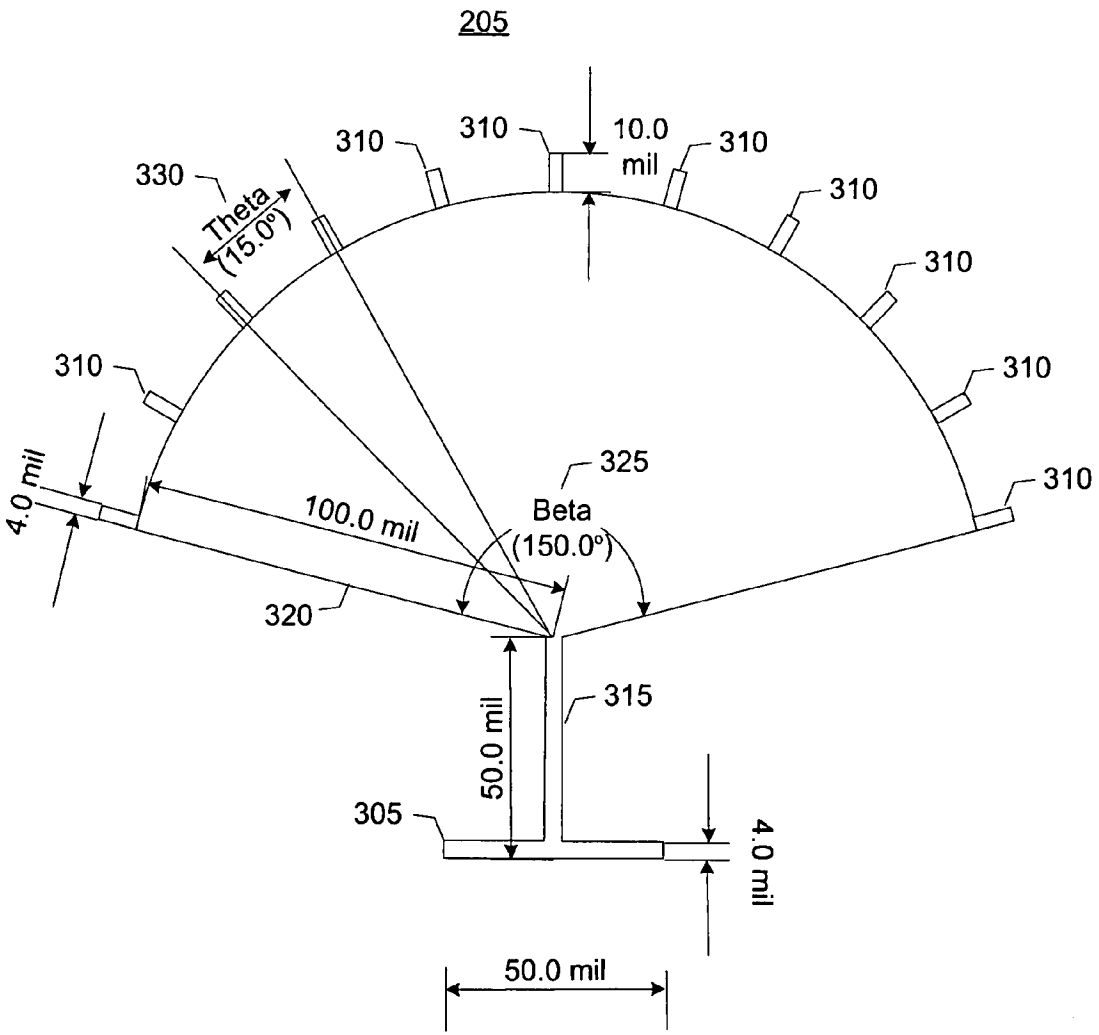
FIG. 4 is a schematic drawing of a pie-divider in accordance with an exemplary embodiment of the present invention.

FIG. 4 is a schematic drawing of a pie-divider 205 in accordance with an exemplary embodiment of the present invention. FIG. 4 shows exemplary dimensions of a pie-divider 205 for use in a particular embodiment. The pie-divider 205 illustrated in FIG. 4 was optimized for use with op-amps 210 having the input characteristics mentioned above. As shown in FIG. 4, the pie-divider has an input region 305, 315, a main body region 320 and a plurality of outputs 310. The dimensions shown in FIG. 4 are but one example of the dimensions of a pie-divider 205 and do not in any way limit the scope of the invention.

In a pie-divider 205 optimized for the exemplary op-amp 210 and having eleven outputs, the pie-divider input 305 may have a nominal width of approximately 4.0 mils and a nominal length of approximately 50.0 mils. The input feed line 315 may have a nominal width of approximately 4.0 mils and a nominal length of approximately 50.0 mils. Additionally, the main body 320 of the pie-divider 205 may be designed in a wedge-like, arc-shaped, or pie-shaped geometry, such as a portion of a circle. Such pie-shaped geometry may provide substantially equal distribution of the input signal to each of the plurality of outputs 310. The wedge may have a nominal radius of approximately 100.0 mils and have a nominal internal angle beta (325) equal to 150.0 degrees. On the outside perimeter of the pie-divider body 320, a plurality of outputs 310 may be positioned. FIG. 4 shows eleven outputs 310. Each output 310 may be substantially in the shape of a rectangle with nominal measurements of approximately 10.0 mils in length and approximately 4.0 mils in width. Alternatively, each output 310 may have a different geometry including, but not limited to, circular, semicircular, elliptical, polygonal, or the like. Each of these outputs 310 may be separated by an angle theta 330 measured from the vertex of the wedge 320. In FIG. 4, the angle theta 330 has a nominal measurement of approximately 15.0 degrees. The above dimensions are preferably used with a circuit board having a pre-preg thickness of 6.6 mil and a dielectric constant of 3.48, and a ground plane thickness of 2.5 mil, and the pie-divider 205 having a thickness of 2.5 mil. Alternatively, those skilled in the art will recognize that the exact geometry and dimensions may be altered in accordance with the preferences of the designer and optimized for input and output load characteristics.

Referring back to FIG. 2, various characteristics of the circuit may be optimized for improved performance. For example, and not limitation, the source transmission line TL0 220 may have a nominal length of approximately 2687.0 mils and a nominal width of approximately 32.0 mils. As shown in FIG. 4, the pie-divider may have a nominal input width of approximately 4.0 mils. Thus, there may be a step reduction in width where the source transmission line 220 meets 260 the pie-divider input 305. The output transmission lines TL1 215 may have nominal lengths of approximately 901.0 mils and nominal widths of approximately 4.0 mils. The termination transmission line TL2 may have a nominal length of approximately 550.0 mils and a nominal width of approximately 4.0 mils. The termination device 270 may include, but is not limited to, a termination capacitor (Cterm) 245 having a nominal capacitance of approximately 270 nF and a termination resistor (Rterm) 250 having a nominal resistance of approximately 21.0 Ohms. The termination capacitor 245 and termination resistor 250 may be connected in series and connected to ground 255. Generally, the termination device 270 may be designed, in combination with the termination transmission line TL2 225, to substantially match the impedance of the pie-divider 205 circuit section to the impedance of the generator 265 section so as to reduce or minimize reflections on the transmission line 220. Those skilled in the art will recognize that the various lengths and widths may be adjusted to optimize the circuit and may even be adjusted, within limits, without affecting the operation of the circuit. For example, and not limitation, the length, width, and depth of various portions of the transmission lines or pie-divider may be adjusted without changing the impedance characteristics of the circuit portion by maintaining substantially consistent volumes of conductive material. Thus, for example and not limitation, the lengths may be shortened by increasing the width of depth of the traces.

Those skilled in the art will recognize that the selection of the values and dimensions of the various components were selected as exemplary embodiments and may be modified to conform to various circuit design parameters. Further, the pie-divider 205 shown in FIGS. 2, 3, and 4 has eleven outputs, however the pie-divider may be modified to include any plurality of outputs and is not limited to eleven outputs.

The descriptions of the various embodiments are not intended to limit the scope of the invention in any way and other alternative embodiments may be practiced without departing from its spirit and scope. Accordingly, the scope of the present invention may be defined by the appended claims rather than the foregoing description.

We claim:

1. An apparatus, comprising:

a first matching section, connected to an input signal, and having a first output and a second output;

a termination section comprising a capacitor connected to a resistor, the termination section connected to the first output; and a pie-shaped impedance matching section connected to the second output and having a plurality of pie-shaped impedance matching section outputs, said pie-shaped impedance matching section outputs having substantially equal phase when connected to a predetermined load impedance.

2. The apparatus of claim 1, wherein said pie-shaped impedance matching section outputs have substantially equal magnitude.

3. The apparatus of claim 1, wherein the pie-shaped impedance matching section has a body section having a wedge-shaped geometry.

4. The apparatus of claim 1, wherein at least one of said plurality of pie-shaped impedance matching section outputs of the pie-shaped impedance matching section has a substantially rectangular geometry.

5. The apparatus of claim 1, wherein the capacitor and the resistor are connected in series forming a series combination and, wherein one terminal of the series combination is connected to circuit ground.

6. The apparatus of claim 1, further comprising:

a plurality of load elements, wherein each load element is connected to one of said plurality of pie-shaped impedance matching section outputs.

7. The apparatus of claim 1, further comprising:

a plurality of op-amps, wherein each op-amp is connected to one of said plurality of pie-shaped impedance matching section outputs.

8. The apparatus of claim 1, further comprising:

a plurality of load elements; and a plurality of transmission lines, wherein each of said transmission lines connect a corresponding one of said load elements to a corresponding one of said pie-shaped impedance matching section outputs of said pie-shaped impedance matching section.

9. The apparatus of claim 1, further comprising:

a plurality of load elements; and a plurality of transmission lines, wherein each of said transmission lines connect a corresponding one of said load elements to a corresponding one of said pie-shaped impedance matching section outputs of said pie-shaped impedance matching section;

wherein each of said plurality of transmission lines is impedance matched to its corresponding load element.

10. The apparatus of claim 1, further comprising a signal generating device in communication with the first matching section.

11. The apparatus of claim 1, wherein the pie-shaped impedance matching section comprises a conductive material.

12. The apparatus of claim 11, wherein the conductive material is copper.

13. A system, comprising:

a first matching section having a first output and a second output;

a termination section connected to the first output, the termination section comprising a resistor connected to a capacitor;

a pie-shaped impedance matching section connected to the second output and having a plurality of outputs, said outputs of said pie-shaped impedance matching section having substantially equal phase when connected to a predetermined load impedance; and a signal generating device in communication with the first matching section.

14. The system of claim 13, wherein the pie-shaped impedance matching section has a body section having a wedge-shaped geometry.

15. The system of claim 13, wherein at least one of said outputs of the pie-shaped impedance matching section has a substantially rectangular geometry.

16. The system of claim 13, wherein the resistor and the capacitor form a series combination and, wherein one terminal of the series combination is connected to circuit ground.

17. The system of claim 13, further comprising:

a plurality of load elements, wherein each load element is connected to one of said plurality of outputs of said pie-shaped impedance matching section.

18. The system of claim 13, further comprising:

a plurality of load elements, wherein each load element is connected to one of said plurality of outputs of said pie-shaped impedance matching section; and wherein one or more of said load elements is an op-amp.

19. The system of claim 13, further comprising:

a plurality of load elements; and a plurality of transmission lines, wherein each of said transmission lines connect a corresponding one of said load elements to a corresponding one of said outputs of said pie-shaped impedance matching section.

20. The system of claim 19, further comprising:

a plurality of load elements; and a plurality of transmission lines, wherein each of said transmission lines connect a corresponding one of said load elements to a corresponding one of said outputs of said pie-shaped impedance matching section;

wherein each of said plurality of transmission lines is impedance matched to its corresponding load element.

21. A method, comprising:

providing a plurality of pie-shaped impedance matching section outputs using a pie-shaped impedance matching section, said outputs having substantially equal phase and magnitude when connected to a predetermined load impedance;

impedance matching an input signal to the pie-shaped impedance section; and providing a termination section connected to the pie-shaped impedance matching section, the termination section comprising a resistor coupled to a capacitor.

22. The method of claim 21, wherein the pie-shaped impedance matching has a wedge-shaped geometry.

23. The method of claim 21, further comprising loading each of said plurality of outputs with a load element.

24. The method of claim 23, further comprising:

impedance matching a plurality of transmission lines connecting each of said load elements to each of said pie-shaped impedance matching section outputs.

25. The method of claim 21, further comprising loading each of said plurality of pie-shaped impedance matching section outputs with an op-amp.

26. The method of claim 21, further comprising:

generating an input signal and providing the generated input signal to the pie-shaped impedance section.

* * * * *